United States Patent [19]

Brusic et al.

[11] 3,939,293

[45] Feb. 17, 1976

[54] METHOD FOR PASSIVATING CHROMIUM

[75] Inventors: Vlasta Brusic, Mount Kisco; Robert O. Lussow, Hopewell Junction, both of N.Y.

[73] Assignee: International Business Machines, Corporation, Armonk, N.Y.

[22] Filed: Apr. 30, 1974

[21] Appl. No.: 465,657

[52] U.S. Cl. ..... 427/403; 427/405; 427/419; 148/6.3; 148/6.31

[51] Int. Cl.[2] ..... C23F 7/02

[58] Field of Search ..... 148/6.3, 6, 6.31, 6.35; 117/71 R, 70 A, 70 C, 129; 427/405, 419, 403

[56] References Cited

UNITED STATES PATENTS

| | | | |
|---|---|---|---|
| 2,217,802 | 10/1940 | Koehring | 148/6.3 |
| 3,480,483 | 11/1969 | Wilkinson | 148/6.3 |
| 3,634,147 | 1/1972 | Helwig et al. | 148/6.35 |

*Primary Examiner*—Cameron K. Weiffenbach
*Assistant Examiner*—Charles R. Wolfe, Jr.
*Attorney, Agent, or Firm*—Sughrue, Rothwell, Mion, Zinn & Macpeak

[57] ABSTRACT

Chromium is passivated by forming a chromium oxide layer thereon by heating at temperatures of about 450°C in an atmosphere containing oxygen. While useful, per se, the process finds particular application as an integral part of overall processing schemes where thermal cycles are used.

11 Claims, 4 Drawing Figures

METHOD FOR PASSIVATING CHROMIUM

BACKGROUND OF THE INVENTION

1. Field of the Invention

The present invention relates to the formation of passivating films of chromium oxide.

2. Prior Art

Techniques for forming an oxide layer on chromium (hereinafter often referred to as passivating) are known, and include the oxidation of bulk chromium and chromium thin films at temperatures above 650°C in oxygen and in impure nitrogen, the initial interaction of chromium thin films and oxygen at temperatures of from −196° to 300°C at a pressure of about $10^{-10}$ torr and the oxidation of chromium/copper films at 525°C in forming gas. See, e.g., C. A. Phalnikar, E. B. Evans and W. M. Baldwin, Jr. *J. Electrochem. Soc.* 103, 429–438 (1956);

V. I. Arkharov, V. N. Konev, *I. Sh. Trakhtenberg and S. V. Shumilina Fig. Metal Metalloved.*, 5, 190–193 (1957);

D. V. Ignatov and R. D. Shamgunova *N.A.S.A. Technical Translation* F-59, 61–68 (1959);

E. A. Gulbransen and K. F. Andrew *J. Electrochem Soc.* 104, 334–336 (1957);

A. U. Seabolt, *J. Electrochem. Soc.* 107, 147–148 (1960);

W. C. Hagel, *Trans. ASM* 56, 583–599 (1963);

R. A. Rapp in *Reactions between Gases and Solids*, AGARD Conference Proceedings No. 52, Technical Editing and Reproduction Ltd., Harford House, 7-9 Charlotte St., London (1970);

O. Kubaschewski and B. E. Hopkins "Oxidation of Metals and Alloys" Acad. Press, New York (1953);

R. E. Grace and T. F. Kassner *Acta Metallurgica* 18, 247 (1970); and

W. A. Crossland and H. T. Roettgers, *Physics of Failure in Electronics* Vol. 5, Ed. T. S. Shilliday et al., Batelle Memorial Int., Columbus, Ohio, Clearing House for Fed. Sci. and Tech. Inf. (1967).

All of the above processes, however, suffer from the fault that they are not easily integrated into the thermal cycles of an already existing process, and generally have to be performed separately from the thermal cycles already existent in the process.

For example, processes for forming gas panel display devices often involve a high temperature thermal cycling step where metallurgy-glass assemblies are subjected to elevated temperatures sufficient to cause the glass to fuse and reflow. A gas panel display device fabrication process involving such a glass reflow step is described in U.S. Pat. No. 3,634,720 to Kupsky.

Known non-thermal techniques for forming a chromium oxide layer on chromium include wet chemical oxidations, anodic oxidations, and the deposition of chromium oxide by a spin drying method. It will be apparent that these procedures cannot easily be integrated with the thermal cycles of an already existent process.

OBJECTS OF THE INVENTION

It is an object of the present invention to provide a process for forming a passivating film of chromium oxide.

A further object of the present invention is to provide a process for passivating chromium, especially thin film chromium, which can be easily integrated with an existent processing sequence involving thermal cycles.

SUMMARY OF THE INVENTION

In accordance with the invention, there is provided a method for passivating chromium comprising the step of oxidizing chromium at a temperature of 425°–475°C in an atmosphere comprising an oxygen partial pressure of about 0.01 to 10 atmospheres.

The foregoing and other objects features and advantages of the invention will be apparent from the following more particular description of a preferred embodiment of the invention, as illustrated in the accompanying drawings.

DESCRIPTION OF A PREFERRED EMBODIMENT

In considering the chromium passivation process, according to the invention, it is to be noted that an important parameter therein is the range of temperature, viz., 425° to 475°C in which the oxidizing step is carried out, the best temperature being at about the mid-point of this range, i.e., 450°C.

To understand the importance of this range, there are considered the results which ensue when chromium is oxidized both at temperatures outside of and within this range.

Thus, for example, when bulk, and thin film, polycrystalline chromium are oxidized at atmospheric pressure in atmospheres containing oxygen in a range of 400°C to 750°C, $Cr_2O_3$ is the main product which is formed at all of these temperatures. With regard to the nature of the surfaces formed during these oxidations, the oxides produced at 400°C and 450°C show a texture which is not present in oxides formed at temperatures of 500°C and greater. In this connection, chromium thin films exhibit more pronounced changes of surface morphology relative to length of oxidation period, temperature and ambient atmosphere than does bulk chromium. Thus, where thin films of chromium are employed, the oxidation reaction causes roughening of the original surface with a pronounced formation of hillocks of oxides interconnected by a thin layer of the oxidation reaction product. The number of hillocks which are formed can be related to the residual stress in the metallic films which in turn results from the temperature at which the films are evaporated. During the oxidation at elevated temperatures, the sizes of the hillocks increase proportionately with time, their number increases with temperature, and their shape is influenced by the ambient atmosphere.

A typical thickness (L)-time variation at temperatures $T \leq 500°C$ shows a linear to cubic transition, i.e., the initial interfacial combination of the reactants is slowed down and further growth rate is determined by the diffusion of the reactive species through the oxide film. The positive dependence of the reaction constant on oxygen partial pressure indicates that the diffusing species is constituted of chromium vacancies. They move with a heat of activation which varies as $\Delta H_{Cr}$, bulk $>\Delta H_{Cr}$, evaporated at 250°C $>\Delta H_{Cr}$, evaporated at RT the values being 32, 31 and 26 k cal/mole, respectively.

In contrast with behavior of bulk chromium, it has been found that chromium films, however, react faster and, at $T \geq 550°C$, the growth rate deviates from the exponential dependence with time, as observed in connection with the bulk chromium and becomes almost linear.

Figure 1:
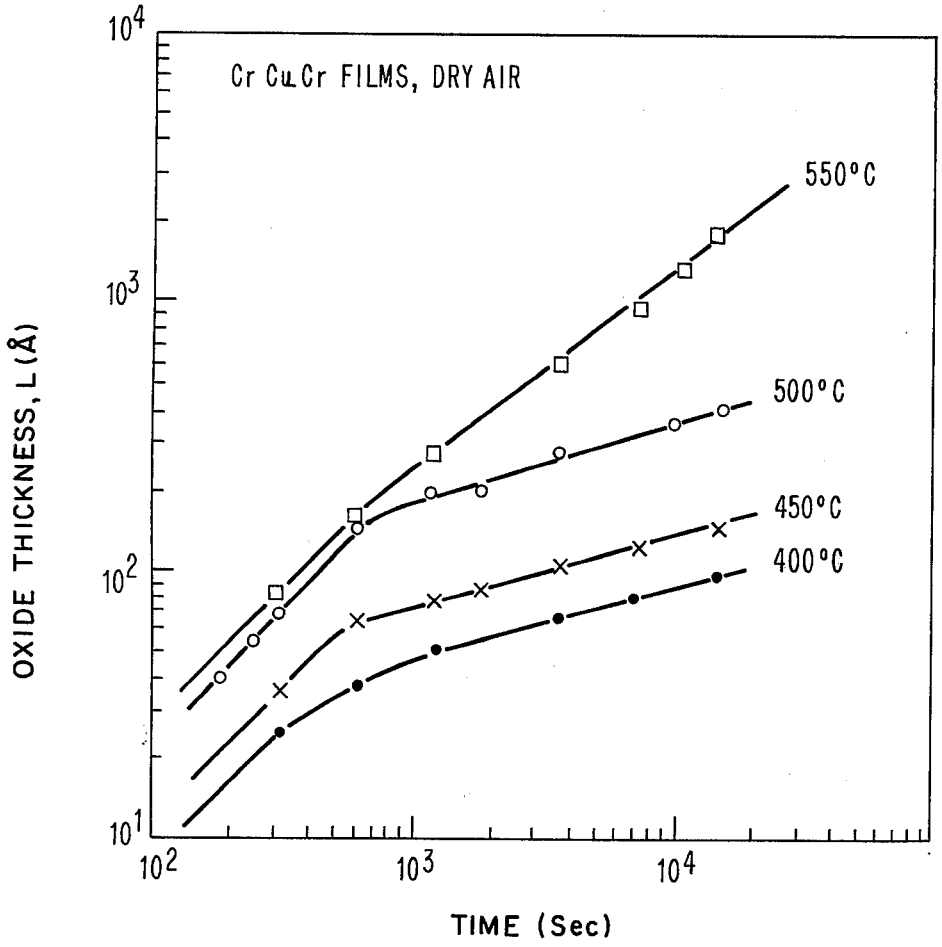
FIG. 1 illustrates the variation of the chromium oxide thickness with time in dry air, on a logarithmic scale, on the upper Cr layers of Cr/Cu/Cr films.

In this connection, reference is made to FIG. 1 wherein there are shown time, oxide thickness plots for the oxidation of CrCuCr films in an $O_2$—$N_2$ mixture substantially corresponding to air, at 400°, 450°, 500° and 550°C. It is to be noted that the oxide film formed at 550°C is not protective toward further oxidation, its growth rate being appreciable. The mechanism which is believed to occur at 550°C is the fast formation of the oxide at some sites combined with the fast depletion of chromium at the Cr/Cr-oxide interface and by a relatively rapid continued arrival of vacancies to form voids and, ultimately, a porous zone at the metal/oxide interface. The latter phenomenon, in turn, weakens the oxide-to-metal adhesion and provides continuously fresh metallic areas which are capable of reacting with oxygen.

As can be seen in FIG. 1, however, the oxide which is formed at 500°C is protective. It has been found that the rate constant increases with $P_0^{1/5}$ and the change of oxygen partial pressure from 1 to 0.2 atmospheres does not change the growth rate appreciably.

Figure 2:
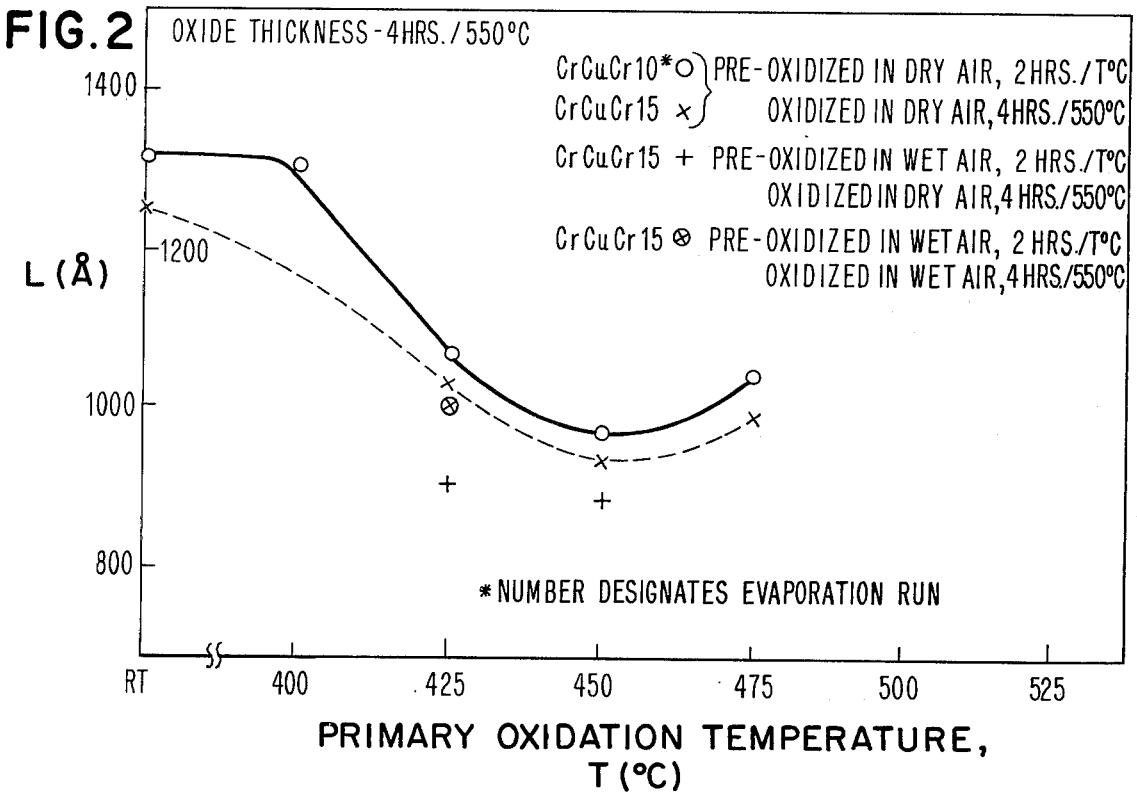
FIG. 2 shows the oxide thickness on the upper Cr layers of Cr/Cu/Cr films after the heating thereof for about 4 hours at 550°C as a function of primary oxidation temperature, there being a pre-oxidation time of about 2 hours.
Figure 3:
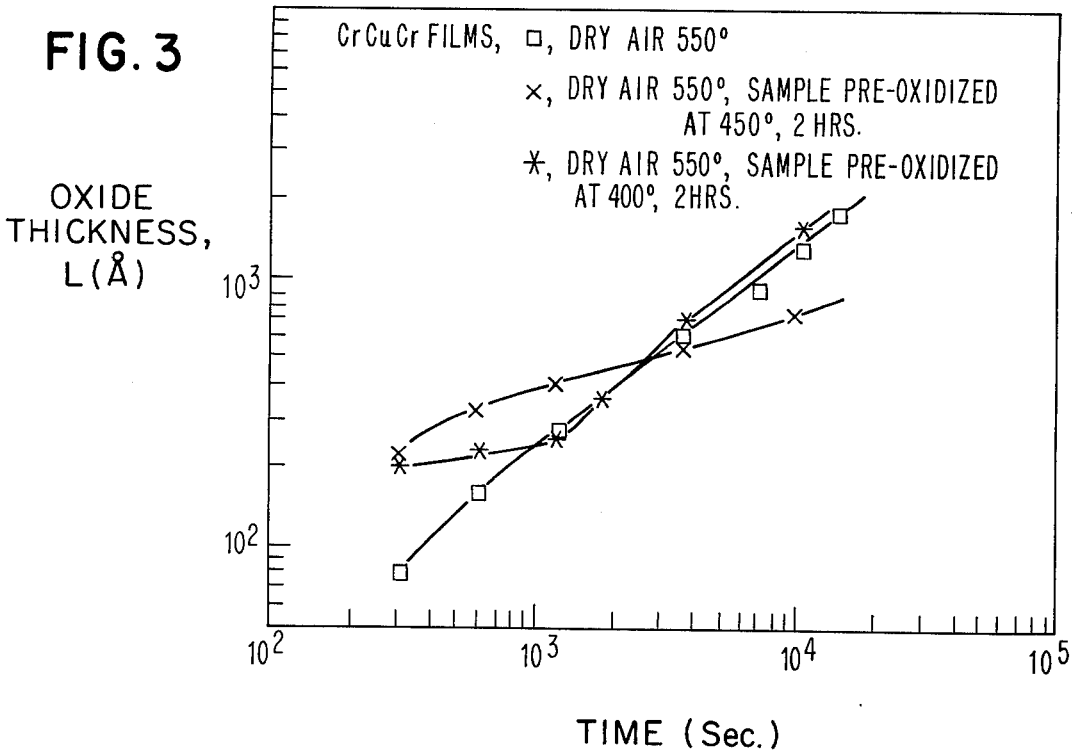
FIG. 3 depicts oxide growth on Cr/Cu/Cr films at 550°C, these films having been pre-oxidized at 400° and 450°C.

FIG. 2 shows the results which ensued from a series of experiments which were performed in order to determine a set of oxidation conditions for chromium to form an oxide that provides greater hindrance to the loss of metallic layer at $T > 500°C$. In this regard, CrCuCr films were oxidized at either 400°, 425°, 450° or 475°C for about two hours and then subsequently oxidized at 550°C for about an additional four hours, the heatings being carried out in both dry and moist atmospheres, the latter atmosphere resulting in a relatively macroscopically uniform surface. A total oxide thickness, at the end of about 4 hours heating at 550°C is essentially lower on pre-oxidized films than on metallic films heated at 550°C. The difference is even more pronounced if the samples have been pre-oxidized in moist air at the lower temperature, and then oxidized in dry air at 550°C. Thus, if the metallic films are heated near 450°C, the optimum protection against further oxidation is obtained. This is not only apparent from the total oxide thickness as shown in FIG. 2 but also from the manner in which the oxide grows at 550°C (FIG. 3). In this connection, films exposed at 400°C are initially resistant to further oxidation but, after about 20 minutes heating at 550°C, the growth limiters revert to linear behavior. Films pre-oxidized at 450°C, however, continue to exhibit a cubic growth, i.e., a diffusion limited oxidation rate, during subsequent oxidation at 550°C.

Further experiments for different times at each of the different pre-oxidation temperatures in lower partial pressures of oxygen indicate that the temperature of the pre-oxidation, rather than the oxide thickness, is the more important factor in the producing of effective protection, i.e., passivation. There follows hereinbelow a discussion as to why oxidation at a temperature centering around 450°C produces the desired optimum results. This discussion is based essentially upon two factors.

One of these factors is the texture of the oxide film observed at temperatures, $T \leq 450°C$. The lack of desired orientation at higher temperatures may be linked to the increase of the mechanical stress as the oxide thickens sufficiently to disturb the epitaxy between the oxide and the metallic substrate. As the chromium oxide grows with the formation of hillocks, small variations of the growth rate along the surface, accompanied by a possible decrease in the bond strength between the metal and the oxide, may be the reason for poorer protection of the films at temperature $T \geq 475°C$.

Figure 4:
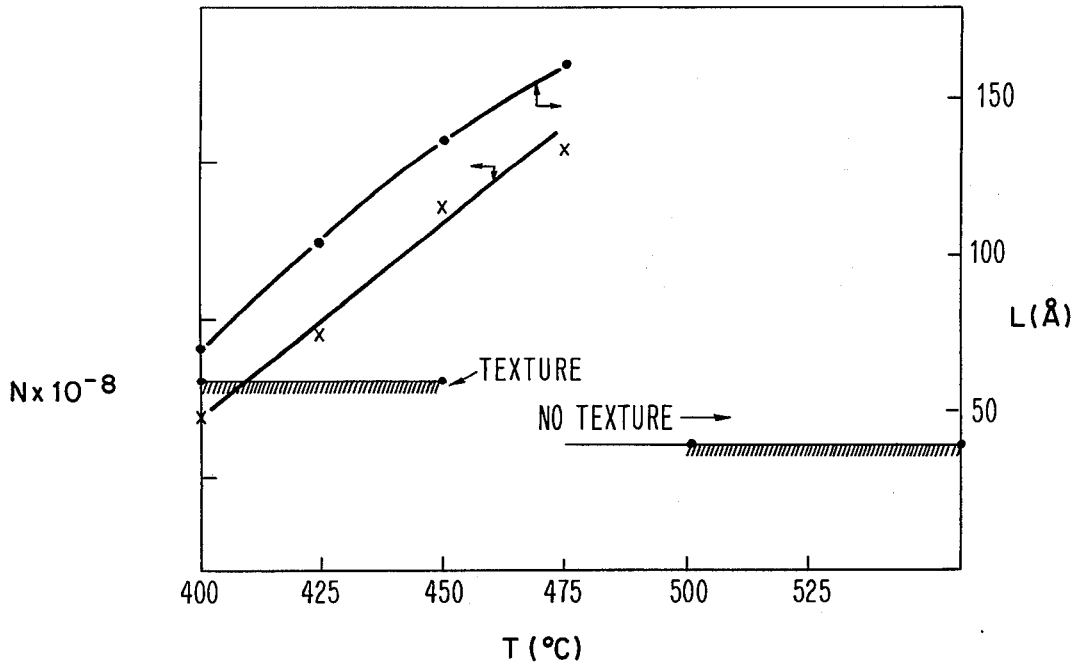
FIG. 4 shows the characteristics of the pre-passivating oxide, i.e., its thickness, number of hillocks per $cm^2$ and texture, as a function of oxidation temperature.

The other of these factors is the morphology of the film. The surface of the oxide formed at $425°C < T < 475°C$ in air, is fine structured. The number of hillocks increases with temperature, as illustrated in FIG. 4. At the low temperature end, a small number of hillocks is formed thereby leaving a fairly large portion of the surface covered only by a very thin oxide. Then, when the temperature is raised to 550°C, both the existing hillocks may increase in size and new hillocks may be formed in the area between them. Such growth of several hillocks of variable size close to each other can result in their merging to cause the formation of larger hillocks in a shorter period, such larger hillocks being capable of more rapid separation from the metallic base with the consequent exposure of fresh metallic areas to the reactive gases.

The oxides formed in the range of 425°C to 475°C and particularly centering around 450°C follow to some extent the orientation of the metallic layer and the size and distribution of the hillocks result in a substantially uniform spacing therebetween. At 550°C, the main growth rate is the three-dimensional increase of the already existing nuclei.

The variation of the oxide thickness which is formed on chromium with time at some temperature has been found to follow a linear to exponential (parabolic and/or cubic) transition. Such growth process can be described by the general equation:

$$L^n + K_A L = K_B t + K_C$$

wherein $L$ is the oxide thickness, $t$ is time and $n$ is the exponent of the second stage in the oxide growth; $K_A$, $K_B$ and $K_C$ are respectively functions of the number of available surface sites for the reaction, the activation energy, the reaction temperature, and the oxygen partial pressure.

The above equation has been proven to obtain in the pressure range of $10 > P_{O_2} > 10^{-4}$ atmospheres.

The simplified form for $P_{O_2}$ of one atmosphere becomes $$\text{Log } L = A + \tfrac{1}{3} \log t - 2.10^{-3} (1/T)$$

wherein A has a value of 4.180 for chromium films and 3.816 for Cr/Cu/Cr films.

The oxidation process according to the invention is advantageously carried out in aqueous mixture substantially equivalent to moist air. The amount of moisture in the atmosphere which is contacted with the chromium at 425°–475°C is not overly critical and, in fact, even traces of moisture therein are sufficient to form the chromium oxide. Generally, however, there should be avoided a quantity of moisture which would form droplets at the passivation conditions since potentially this could lead to corrosion of the chromium. For example, most typically, the chromium (generally present as a component of a device being fabricated) is inserted into a furnace, the furnace temperature is elevated to a temperature within the above range and air is slowly passed over the chromium by bubbling it through a water bubbler at normal room pressure and temperature.

While the passivation process of the invention can be used to passivate both bulk and thin film chromium, it finds particular application in the passivating of the thin film chromium, such as, for example, a thin film of chromium on the order of 800 to 2,500 angstroms. By present state of the art thin film formation techniques, it is often difficult to form thin films of chromium at thicknesses substantially less than 800 angstroms which are uniform. Also, at thicknesses much above 5,000 angstroms chromium tends to be highly stressed and to show inferior passivation results. In addition, with bulk chromium, the passivation layer formed is thinner than that which can be achieved under equivalent conditions with thin film chromium. The latter phenomenon is most likely due to differences in the stress levels and the density between bulk chromium and thin film chromium.

Accordingly, the following discussion is in connection with the preferred embodiment of the invention, i.e., where a thin chromium film is passivated, since such films not only can be passivated to provide superior protection but find great commercial utility.

The pressure of the passivation system is not overly important. For example, oxygen partial pressures of from about 0.01 atmosphere to about 10 atmoshperes (air systems) have been used with success in the passivation process according to the invention. However, generally operation is at approximately atmospheric pressure. As oxygen partial pressure is increased in the process, generally the rate of chromium oxide formation increases in an exponential manner, with a rate constant proportional to $P_0^{1/5}$ (where $P_0$ is the oxygen partial pressure).

The time for passivation will, of course, depend upon the desired thickness of the passivation layer. Increasing treatment times increase the thickness of the passivation layer and decreasing treatment times have the converse effect. In this regard, it is to be noted that during the first 10 to 20 minutes of the passivation process according to the invention, the chromium oxide film grows relatively rapidly in a linear manner, but during this initial growth stage, it cannot as yet be considered an effective passivation film. However, after this initial linear growth period, the rate of oxide growth significantly decreases, and the chromium oxide film assumes its passivating, protective nature. It is believed that the passivation process is, in some manner, diffusion controlled, with the chromium oxide layer being partially self-inhibiting after the initial linear chromium oxide growth period.

Considering the above facts, on a commercial scale it is most preferred to provide a substantial time safety factor for the time of the passivation process, and generally the passivation process will be carried out for a minimum of about 1 hour, more preferably passivation being conducted for a time on the order of two hours at 450°C to thereby provide a chromium oxide layer on the order of 85 to 100 angstroms thick.

While longer passivating times can be employed, considering the desirability of shortening the process time and the balancing of this against the self-inhibiting nature of the chromium oxide film, which increases with increasing thickness, for many commercial applications where thin chromium films are involved, a maximum passivation time of about 2½ hours may be used.

It is desirable that the air, preferably moist, be flowed very slowly over the chromium substrate. While, in theory, a static mass of moist air or a rapidly flowing mass of moist air could be used, in practice this proves inadvisable for the following reasons. First, a static mass of moist air is preferably not used in order to avoid the possibility that the moist air composition at the moist air/chromium interface might be locally depleted during reaction, thereby leading to varying oxide formation rates. On the other hand, a rapidly flowing stream of moist air should be avoided because of the possibility of causing temperature variations over the chromium, which could also lead to varying oxide formation rates. Accordingly, the flow of air is established to provide a substantially constant concentration of reactants at the moist air/chromium interface without substantial temperature variation of the chromium.

For instance, using a flow-through tube furnace 2 inches in diameter and 36 inches in length, a moist air flow rate of 2 liters per minute provides excellent results, the moist air being under a slight positive pressure to insure flow.

The use of air, preferably moist, is an important aspect of the present invention. Dry air can, of course, also be used to oxidize chromium and, in fact, can provide a passivated layer of substantially the same thickness as is obtained with moist air under the same conditions. However, the morphology of a chromium oxide layer obtained using moist air differs significantly from one obtained using dry air, the latter being less uniform. While the exact reason for this surprising difference is not understood, it is believed that with dry air the chromium oxide layer grows at varying rates across the surface because of the generation of active and inactive sites, while with moist air, the inactive sites become activated to provide numerous small nucleation sites, leading to uniform surface morphology.

The passivation process according to the invention finds particular application where it is desired to form an oxide film on chromium in order to increase the durability of the chromium to processing conditions.

The following example deals with such a use of the passivation process according to the invention, and is given with specific reference to the formation of conductor metallurgy on a glass substrate which is overcoated with a dielectric glass reflowed thereon at high temperatures, the assembly comprising a portion of a gas panel display device.

EXAMPLE

In the following example, the metallurgy was carried on a glass substrate and comprised a three-layer structure of chromium-copper-chromium, the layer thickness being 900–2,000 angstroms, 18–25K angstroms and 900–2000 angstroms, respectively.

During fabrication, the metallurgy is coated or encapsulated with a layer of dielectric glass by reflowing a dielectric glass frit which has been applied to the metallurgy. The upper layer of chromium serves as a protective layer to protect the copper layer from oxidation by the ambient atmosphere during the glass reflow or from chemical attack by the molten dielectric glass during the reflow.

However, untreated metallic chromium is insufficient to protect the copper during the reflow process since chromium itself can be attacked by oxygen, water or the molten dielectric glass during the reflow process; accordingly, a layer of chromium oxide is formed on the surface of the uppermost chromium layer to "passivate" the chromium against attack during the glass reflow process.

The lower chromium layer functions as an adhesion promoter between the glass and the copper layer.

In the present example, the metallurgy was applied by state of the art vacuum evaporation techniques at $10^{-6}$ mm Hg.

The glass substrate was, in this example, a sodalime glass, but this is not overly important and any glass could have been used which does not degrade the chromium at the processing conditions.

The metallurgy was then coated with a dielectric glass frit which is to be reflowed at elevated temperatures to form the encapsulating dielectric glass layer. Application of the glass frit can be by any known procedure; in this case, it was applied by spraying in a slurried form. Such a slurry comprises a binder, solvent therefor and the glass frit.

Suspension systems suitable for use for the slurry are about 2 wt. percent nitrocellulose in amyl acetate or 2.5 wt. percent dibutyl phthalate, 5 wt. percent polymethyl methacrylate and 92.5 wt. percent ethyl cellosolve acetate. The frits suitably had an average particle size of about $7\mu$ and were mixed with the suspension systems at a 1:1 weight ratio.

The dielectric frits were each applied to separate substrate/metallurgy assemblies to a thickness of $0.7 \approx 1.4$ mil; the glass frit coated metallurgy carried on the glass substrate inserted into a flow-through tube furnace 2 inches in diameter and 36 inches in length and the temperature thereafter raised at a rate of 1°C per minute from room temperature to the passivation temperature of 425°C to volatilize the solvent and burn away the binder before the passivation temperature was reached. After the binder and solvent were removed by volatilization and combustion, the layer of glass frit assumed a porous nature, i.e., it was powder-like and lightly adhered to the metallurgy.

Once a substrate carrying the dielectric glass frit encapsulated metallurgy reached 425°C, water vaopr was added to the furnace by passing air through a room temperature bubbler to provide a water content of about 23mm, the resulting moist air being passed through the reflow furnace at a rate of 2 liters/minute for 2 hours while holding the system at 425°C.

At the end of 2 hours, the introduction of water vapor was terminated, the ambient in the reflow furnace returned to dry oxygen and the temperature quickly raised to 625°C, i.e., to a temperature above the melting point of the dielectric glass frit in each run, to reflow the glass onto the conductor metallurgy.

The oxide layer formed by the passivation procedure described had a thickness of approximately 80 to 100 angstroms.

It is to be noted that earlier it was emphasized that the oxidation or passivation temperature is optimum at about 450°C, but in the present example the passivation was conducted at 425°C. The temperature of operation in this example represents a balance between achieving optimum passivation at 450°C and minimizing sintering or fusing of the glass powder in the glass frits during the passivation cycle. In this case, the glass transition temperature ($T_g$) of the glass powders used was slightly in excess of 425°C, and accordingly, the passivation procedure was conducted to avoid fusing of the glass prior to the subsequent elevation to the actual reflow temperature. If the glass frit fuses during the passivation technique, the porous layer of glass frit which provides a more uniform surface morphology in the chromium oxide layer is lost.

For some reason which is not completely understood, a porous glass frit serves to improve the properties of the chromium oxide layer which is formed during the passivation process according to the invention, primarily the surface morphology. The exact reason that a glass frit improves the chromium oxide layer which is formed is not understood since it has not been determined that there is a significant chemical reaction occurring between the chromium or chromium oxide and the glass frit.

The glass frit serves primarily a physical function and, accordingly, the exact identity of the glass which is used in the glass frit is not overly important at passivation temperatures. It is theorized that the glass frit might help to reduce, in some manner, the oxygen partial pressure at the glass frit/chromium interface and may even prevent the formation of overly large nucleation sites on the chromium which would lead to uneven surface thickness. In any event, a much more uniform chromium oxide layer is obtained in the case when a glass frit is used than under identical conditions where a frit is not used.

Although the exact composition and particle size of the glass frit does not appear to be overly important at the passivation temperature, there should, of course, be selected a glass frit which has a composition that meets the encapsulating requirements of the final device, and in this regard, glass frits, as have been used in the art for their protective encapsulating function after high temperature reflow, can be used according to the invention, e.g., glasses from the borosilicate family.

The chemical and physical requirements which such glasses must meet, e.g., thermal coefficient of expansion close to that of the substrate to avoid warping, low alkali metal oxides to avoid lowering favorable electrical properties, melting points below that of device metallurgy, size appropriate to form a mixture of appropriate viscosity with the binder system, and the like are sufficiently well know such that they need not be discussed in detail.

The glass:binder system ratio and thickness of the coating of the frit are also determined upon considering standards known in the art, bearing in mind that at glass frit layer thicknesses much below about 0.1 mil, it is difficult to obtain uniform coating thicknesses without time-consuming multiple applications and that with glass frit thicknesses much greater than about 2 mil, bubble escape during reflow becomes difficult.

It will be apparent to one skilled in the art that the invention is not limited to the fabrication of gas panel display devices, Rather, it can be used to passivate chromium under any circumstances, finding particular application as an integral part of a larger overall processing where an in situ chromium passivation is required.

While the invention has been particularly shown and described with reference to a preferred embodiment thereof, it will be understood by those skilled in the art that various changes in form and details may be made therein without departing from the spirit and scope of the invention.

What is claimed is:

1. A process for passivating chromium which comprises contacting chromium at a temperature of from about 425°C to about 475°C with $O_2$ for a period of time greater than twenty minutes to grow a passivating chromium oxide film thereon.

2. The process of claim 1 where the temperature is about 450°C.

3. The process of claim 1 wherein the chromium is in the form of a thin film.

4. The process of claim 3 wherein the chromium has a thickness of from about 800 angstroms to about 2,500 angstroms.

5. The process of claim 1 wherein the process is conducted at an oxygen partial pressure of from about 0.01 atmosphere to about 10 atmospheres.

6. The process of claim 1 wherein said contacting is conducted while said chromium is coated with a particulate glassy frit.

7. The process of claim 1 wherein moist air is slowly flowed over the chromium to provide said oxygen.

8. The process of claim 1 wherein said chromium is overcoated on a thin layer of copper which is in turn overcoated on a second thin layer of chromium adhering to a glass substrate.

9. The process of claim 8 wherein said second thin layer of chromium adhering to said glass substrate covers said glass substrate.

10. The process of claim 1 wherein the process is conducted at a oxygen partial pressure of from about 0.01 atmosphere to about 10 atmospheres and wherein moist air is slowly flowed over the chromium to provide said oxygen.

11. The process of claim 1 wherein said contacting is carried out for a minimum of about 1 hour to a maximum of about two and one-half hours.

* * * * *

UNITED STATES PATENT AND TRADEMARK OFFICE

CERTIFICATE OF CORRECTION

PATENT NO. : 3,939,293

DATED : February 17, 1976

INVENTOR(S) : Vlasta Brusic et al

It is certified that error appears in the above-identified patent and that said Letters Patent are hereby corrected as shown below:

Column 3, line 38, delete "$P_0^{1/5}$" and insert -- $P_{0_2}^{1/5}$ --

Column 5, line 45 - delete '$P_0$' (both occurrences) and insert -- $P_{0_2}$ --

Column 7, line 19, insert hyphen between "soda" and "lime"

Column 8, line 52, delete "know" and insert -- known --

Signed and Sealed this eighteenth Day of May 1976

[SEAL]

*Attest:*

RUTH C. MASON
*Attesting Officer*

C. MARSHALL DANN
*Commissioner of Patents and Trademarks*

Dedication 3,939,293.—*Vlasta Brusic,* Mount Kisco, and *Robert O. Lussow,* Hopewell Junction, N.Y. METHOD FOR PASSIVATING CHROMIUM. Patent dated Feb. 17, 1976. Dedication filed July 18, 1979, by the assignee, *International Business Machines Corp.*

Hereby dedicates all claims for the entire remaining term of said patent to the Public.

[*Official Gazette November 16, 1982.*]